US006975703B2

(12) United States Patent
Wilson et al.

(10) Patent No.: US 6,975,703 B2
(45) **Date of Patent: *Dec. 13, 2005**

(54) NOTCHED TRANSMISSION TARGET FOR A MULTIPLE FOCAL SPOT X-RAY SOURCE

(75) Inventors: Colin Richard Wilson, Niskayuna, NY (US); Mark Ernest Vermilyea, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 47 days.

This patent is subject to a terminal disclaimer.

(21) Appl. No.: 10/633,251

(22) Filed: Aug. 1, 2003

(65) Prior Publication Data

US 2005/0025283 A1 Feb. 3, 2005

(51) Int. Cl.[7] ..... H01J 35/08
(52) U.S. Cl. ..... 378/124; 378/119; 378/134; 378/143
(58) Field of Search ..... 378/119, 121, 122, 378/124, 134, 136, 143; 250/493.1, 494.1, 250/505.1

(56) References Cited

U.S. PATENT DOCUMENTS 4,250,425 A * 2/1981 Gabbay et al. ..... 378/125
4,837,793 A * 6/1989 Frankel et al. ..... 378/34
4,860,328 A * 8/1989 Frankel et al. ..... 378/34
4,872,189 A * 10/1989 Frankel et al. ..... 378/119
5,335,255 A * 8/1994 Seppi et al. ..... 378/4
5,383,232 A * 1/1995 Gabbay et al. ..... 378/124
5,629,970 A * 5/1997 Woodruff et al. ..... 378/143
6,125,167 A * 9/2000 Morgan ..... 378/124

* cited by examiner

*Primary Examiner*—David V. Bruce
*Assistant Examiner*—Courtney Thomas
(74) *Attorney, Agent, or Firm*—Jean K. Testa; Patrick K. Patnode

(57) ABSTRACT

A flat panel x-ray tube assembly is provided comprising a cathode assembly including a plurality of emitter elements. An anode substrate is included having a substrate upper surface facing the plurality of emitter elements and a substrate lower surface. The substrate upper surface is positioned parallel to the plurality of emitter elements. A plurality of target wells are formed in the substrate upper surface. Each of the plurality of target wells comprises a first angled side surface positioned at an acute angle relative to the substrate upper surface. A plurality of first target elements is applied to each to one of the first angled side surfaces. The first target elements generate x-rays in a direction perpendicular to the plurality of emitter elements in response to electrons received from one of the plurality of emitter elements.

18 Claims, 3 Drawing Sheets

NOTCHED TRANSMISSION TARGET FOR A MULTIPLE FOCAL SPOT X-RAY SOURCE

TECHNICAL FIELD

The present invention relates generally to an x-ray target assembly, and more particularly, to an x-ray target assembly incorporating multiple focal spots.

BACKGROUND OF THE INVENTION

X-ray production is traditionally accomplished through the process of colliding an electron beam of charged particles with a target assembly. X-rays are produced from the interaction of the electron beam and atoms within the target assembly. This is accomplished through the use of target assemblies with high atomic numbers. The electrons are usually produced by a hot filament and are accelerated to the target by a large potential. When they strike the target, they are deflected by the target atoms and this generates the x-rays. This is the principal mechanism for the production of x-rays for use in computed tomography systems.

Unfortunately, in many target assemblies utilized in CT systems a large percentage of the electron energy is dissipated as heat. This generates a multitude of problems. Many existing target assemblies may not generate sufficient x-rays without a significant introduction of electron energy. Increase in electron energy in these designs, however, further increases the energy that must be dissipated as heat. This, in turn, creates a danger to the target surface and is known to melt the target surface if not carefully controlled. Heat dissipation in combination with adequate x-ray production can also place difficulties on the reduction of x-ray focal spot dimensions.

Flat-panel transmission x-ray source designs are presently utilized to generate multiple focal spots on the imaging object simultaneously. The use of such multiple focal spot imaging can improve volumetric CT imaging. Existing multiple focal spot designs, however, often suffer from the aforementioned concerns regarding the difficulty of generating sufficient x-rays in order to generate good CT images without melting the target assembly.

It would, therefore, be highly desirable to have an improved target assembly capable of generating an increase number of x-rays without melting the target assembly. It would additionally be highly desirable to have an improved target assembly that could provide reduced focal spot dimensions. Finally it would be highly desirable to have an improved target assembly suitable for use in multi-focal spot imaging such that volumetric CT imaging and perfusion studies can be improved.

SUMMARY OF THE INVENTION

A flat panel x-ray tube assembly is provided comprising a cathode assembly including a plurality of emitter elements. An anode substrate is included having a substrate upper surface facing the plurality of emitter elements and a substrate lower surface. The substrate upper surface is positioned parallel to the plurality of emitter elements. A plurality of target wells are formed in the substrate upper surface. Each of the plurality of target wells comprises a first angled side surface positioned at an acute angle relative to the substrate upper surface. A plurality of first target elements is applied to each to one of the first angled side surfaces. The first target elements generate x-rays in a direction perpendicular to the plurality of emitter elements in response to electrons received from one of the plurality of emitter elements.

Other features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
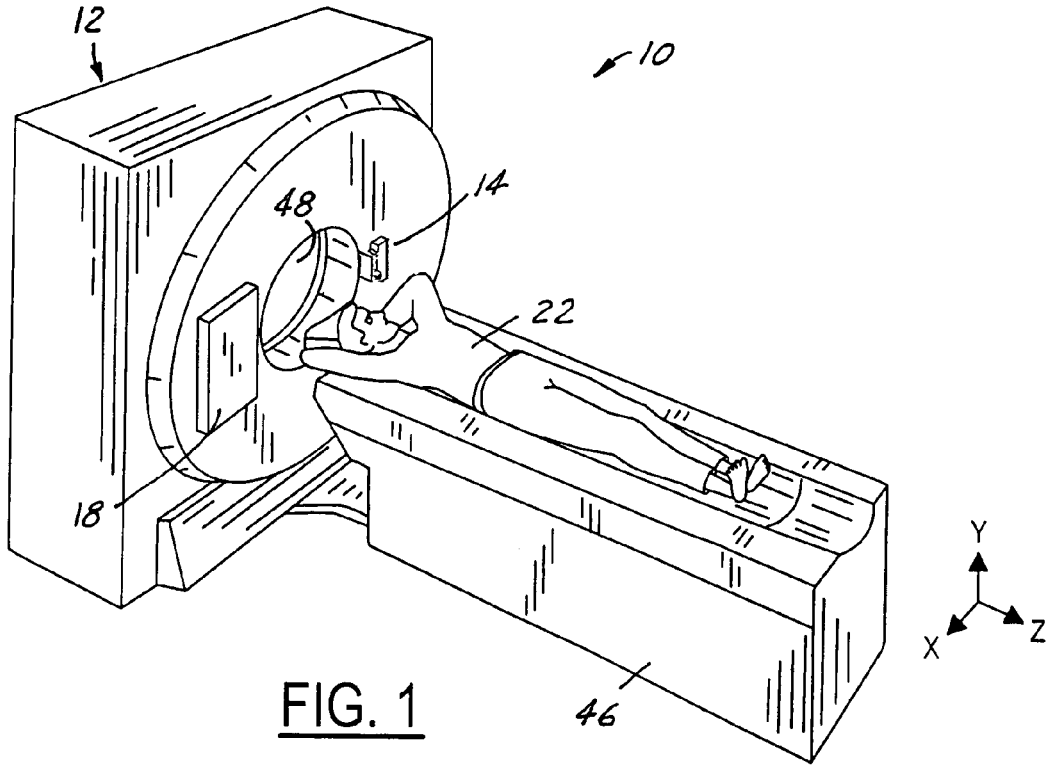
FIG. 1 is an illustration of a medical imaging system for use with the flat panel x-ray tube assembly in accordance with one embodiment of the present invention.
Figure 2:
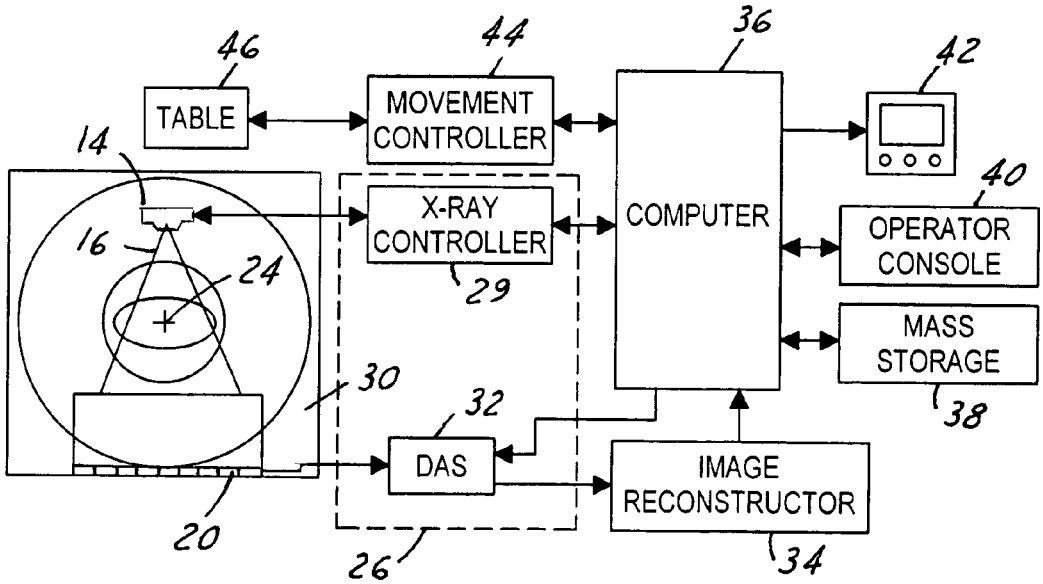
FIG. 2 is a detailed illustration of the medical imaging system as described in FIG. 1.

Referring now to FIG. 1, which is an illustration of a computed tomography (CT) imaging system 10 for use with the flat panel x-ray tube assembly 14 of the present invention. Although a particular CT imaging system 10 has been illustrated, it should be understood that the flat panel x-ray tube assembly 14 of the present invention can be utilized in a wide variety of imaging systems. The CT imaging system 10 includes a scanner assembly 12 illustrated as a gantry assembly. The scanner assembly 12 includes the flat panel x-ray tube assembly 14 for projecting a beam of x-rays 16 toward a detector assembly 18 positioned opposite the flat panel x-ray tube assembly 14. The detector assembly 18 includes a plurality of detector elements 20 which combine to sense the projected x-rays 16 that pass through an object, such as a medical patient 22. Each of the plurality of detector elements 20 produces an electrical signal that represents the intensity of an impinging x-ray beam and hence the attenuation of the beam 16 as it passes through the object of patient 22. Commonly, during a scan to acquire x-ray projection data, the scanner assembly 12 is rotated about the center of rotation 24. In one embodiment, illustrated in FIG. 2, detector elements 20 are arranged in one row such that projection data corresponding to a single image slice is acquired during a scan. In other embodiments, the detector elements 20 can be arranged in a plurality of parallel rows, such that projection data corresponding to a plurality of parallel slices can be acquired simultaneously during a scan.

The rotation of the scanner assembly 12 and the operation of the flat panel x-ray tube assembly 14 are preferably governed by a control mechanism 26. The control mechanism 26 preferably includes an x-ray controller 29 that provides power and timing signals to the flat panel x-ray tube assembly 14 and a scanner motor controller 30 that controls the rotational speed and position of the scanner assembly 12. A data acquisition system (DAS) 32 in control mechanism 26 samples analog data from the detector elements 20 and converts the data to digital signals for subsequent processing. An image reconstructor 34 receives sampled and digitized x-ray data from DAS 32 and performs high speed image reconstruction. The reconstructed image is applied as an input to a computer 36 which stores the image in a mass storage device 38.

The computer 36 also can receive commands and scanning parameters from an operator via console 40 that has a keyboard or similar input device. An associated display 42 allows the operator to observe the reconstructed image and other data from the computer 36. The operator supplied commands and parameters are used by computer 36 to provide control signals and information to the DAS 32, x-ray controller 28, and scanner motor controller 30. In addition, the computer 36 operates a table motor controller 44 which controls a motorized table 46 to position patient 22 within the scanner assembly 12. Particularly, the table 46 moves portions of the patient 22 through the scanner opening 48.

Figure 3:
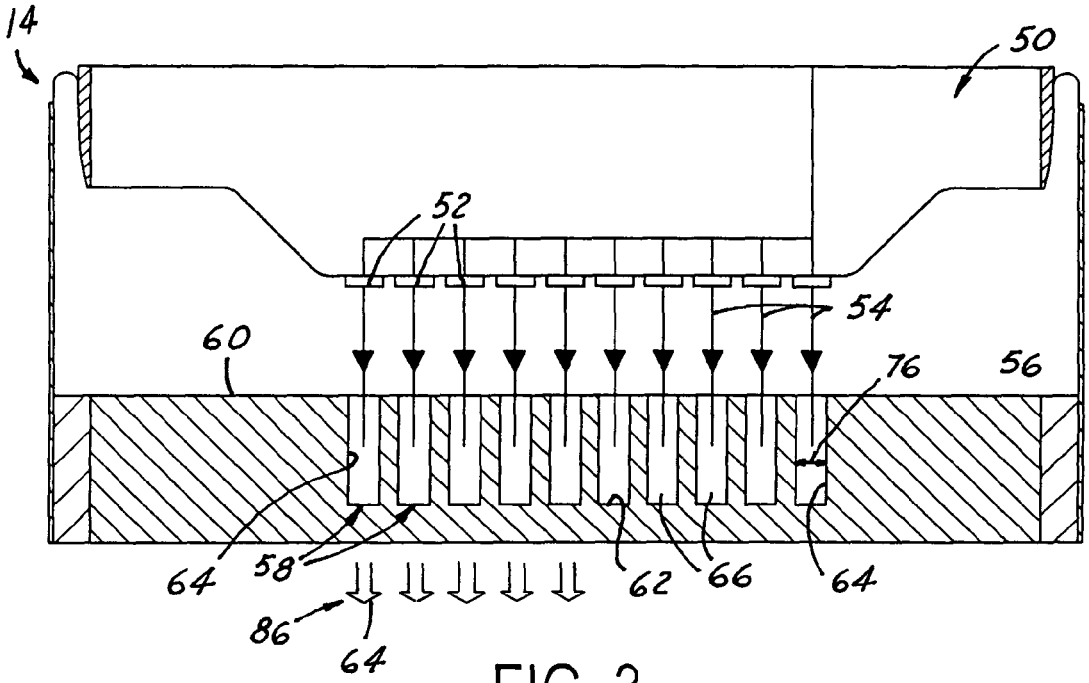
FIG. 3 is a cross-sectional view of an embodiment of the flat panel x-ray tube assembly in accordance with the present invention.

A detailed illustration of the flat panel x-ray tube assembly 14 is illustrated in FIG. 3. The flat panel x-ray tube assembly 14 includes a cathode assembly 50 having a plurality of emitter elements 52 for the generation of electron beams 54. Creating a high potential between the cathode assembly 50 and an anode substrate 56 generates the electron beams 54. Although the anode substrate 56 may be formed from a variety of materials, one embodiment contemplates the use of a graphite substrate. The present invention further includes a plurality of target wells 58 formed in the substrate upper surface 60 of the anode substrate 56. The substrate upper surface 60 is generally orientated parallel with the plurality of emitter elements. Each of these target wells 58 is aligned to correspond to one of the electron beams 54. The target wells include a target well base 62 and a plurality of target walls 64.

Figure 4:
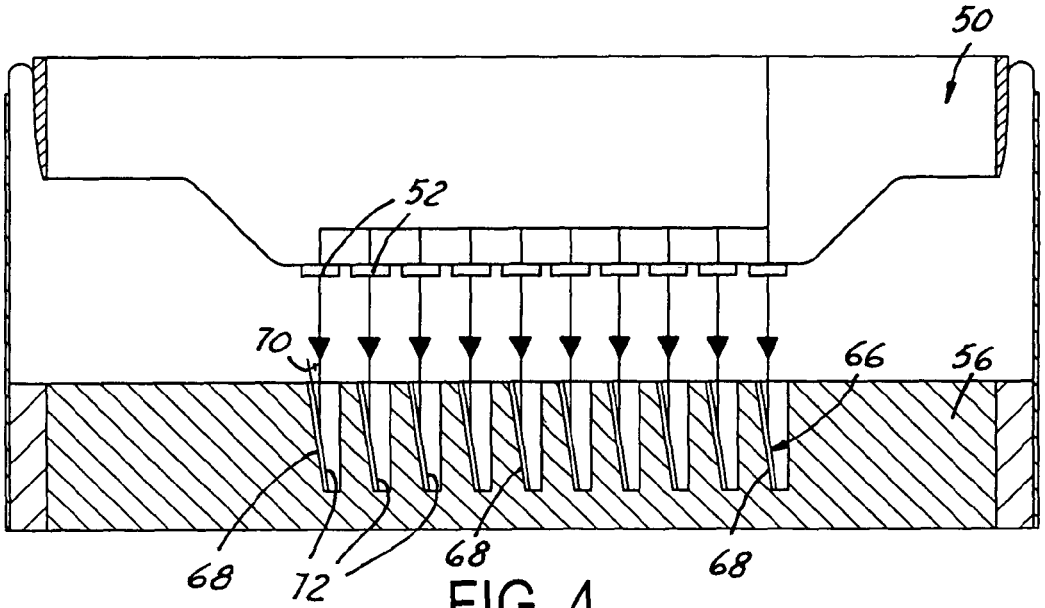
FIG. 4 is side view illustration of the flat panel x-ray tube assembly illustrated in FIG. 3.

The electron beams 54 are generated and directed toward the anode substrate 56 for the purpose of generating x-rays and specifically a plurality of x-ray focal spots 64. An individual x-ray focal spot 64 is associated with each the target wells 58 such that imaging such as volumetric imaging can be performed. The x-rays are generated by impacting the electron beams 54 into a target element 66. The present invention provides a unique approach to this methodology by including a plurality of first angled side surface 68 within the anode substrate 56. The plurality of first angled side surfaces 68 are orientated at an acute angle 70 relative to the substrate upper surface 60 (see FIG. 4). Additionally, the first angled side surfaces 68 are orientated at an acute angle 70 relative to the electron beams 54. A first target element 72 is mounted to each of the plurality of first angled side surfaces 68 to receive the electron beams 54 and generate the focal spots 64. The first target element 72 is preferably mounted parallel to the first angle side surface 68 such that the electron beam 54 impacts it at an acute angle 70. Although the first target element 72 may be formed from a variety of materials, it is preferably a metal with a high atomic number. In one embodiment, the first target element 72 is a thin layer of tungsten coated on the first angled side surfaces.

Figure 5:
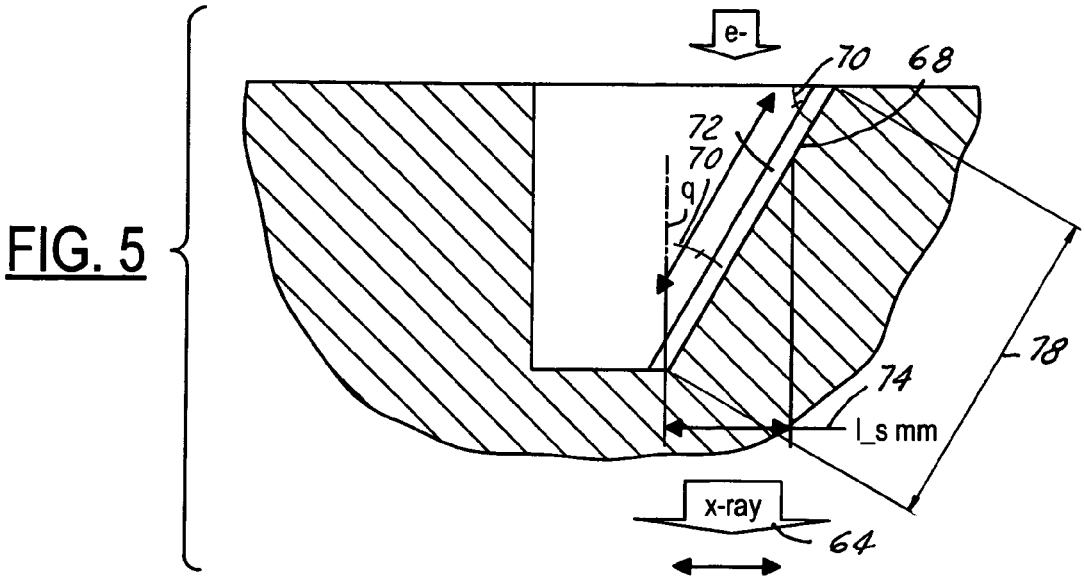
FIG. 5 is detailed illustration of an embodiment of a target well for use in the flat panel x-ray tube assembly illustrated in FIG. 3.

The advantages of the present invention are easily demonstrated in FIG. 5. The target effective length (l_s) 74 multiplied by the target width (w_s) 76 provides the optical focal surface area. The angled first target element 72 provides a smaller focal spot 64 than would the equivalent flat target. This provides for improved narrowing of the focal spot 64 which can be used to improve image quality. In addition, since the target effective length 74 is smaller than the target actual length 78, longer target actual lengths 78 can be used. By placing the first target element 72 in thermal communication with the anode substrate 56, the longer target actual length 78 improves heat dissipation from the first target element 72 into the anode substrate 56. This allows for an increased production of x-rays without melting the first target element 56. In this fashion the present invention provides for an improve geometry that increases the percentage of generated electrons. In addition, the present invention provides a long thermal length (target actual length 78) and small x-ray focal spot dimensions (target effective length 74).

Figure 6:
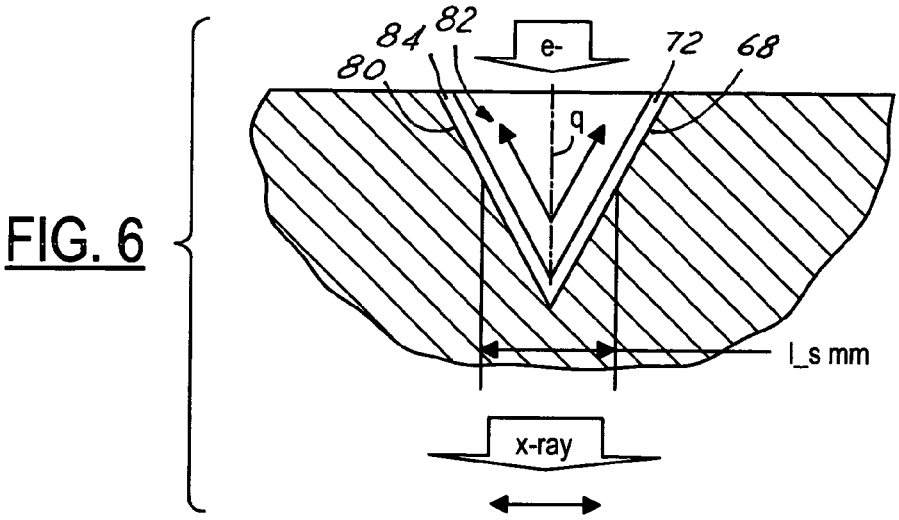
FIG. 6 is detailed illustration of an alternate embodiment of a target well for use in the flat panel x-ray tube assembly illustrated in FIG. 3.
Figure 7:
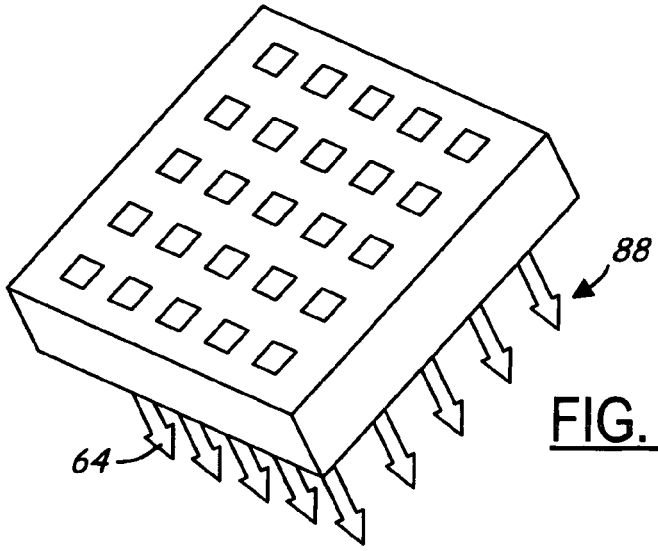
FIG. 7 is an illustration of an alternate embodiment of the flat panel x-ray tube assembly illustrated in FIG. 3, the embodiment illustrating a two-dimensional matrix of target wells.

It is contemplated that the present invention can further include a plurality of second angled side surfaces 80 formed in the anode substrate 56. It is contemplated that each of the plurality of second angled side surfaces 80 faces a corresponding one of the plurality of first angled side surfaces 68. In this fashion, a v-shaped target well 82 is formed (see FIG. 6). On each of the second angled side surfaces 80 a second target element 84 is mounted or coated. The second target elements 84 are also preferably in thermal communication with the anode substrate 56 such that thermal energy from the generation of x-rays may be dissipated into the anode substrate 56. It is contemplated that the second target element 84 and the first target element 56 may be applied as a single target element. In this arrangement, the first target element 56 and second target element 84 act in concert to generate a single focal spot 64. The embodiment in FIG. 6 can be utilized to provide a wider spatial spread of photons in order to reduce "heel effect". Although the first target element 56 and second target element 84 are illustrated as a single element, it should be understood that they may be physically separated in order to generate two closely spaced focal spots.

Although the plurality of target wells 58 and target elements 56 have thus far been illustrated in a line of target wells 86 producing a plurality of focal spots 64 along a linear line, it should be understood that the plurality of target elements 56 may in fact be arranged in two dimensional matrix of target wells 88 that generate focal spots 64 along a two-dimensional matrix. This particular embodiment, when taken in light of the advantages provided by the structure of the present invention, can provide numerous benefits to imaging applications such as volumetric CT imaging.

While particular embodiments of the invention have been shown and described, numerous variations and alternative embodiments will occur to those skilled in the art. Accordingly, it is intended that the invention be limited only in terms of the appended claims.

What is claimed is:

1. A flat panel x-ray tube assembly comprising:

a cathode assembly including a plurality of emitter elements;

an anode substrate having a substrate upper surface lacing said plurality of emitter elements and a substrate lower surface, said substrate upper surface positioned parallel to said plurality of emitter elements;

a plurality of target wells toned as at least one line of target wells in said substrate upper surface, each of said plurality of target wells comprising an first angled side surface positioned in an acute angle relative to said substrate upper surface; and a plurality of first target elements applied one to each of said first angled side surfaces, said first target elements generating x-rays in a direction perpendicular to said plurality of emitter elements in response to electrons received from one of said plurality of emitter elements.

2. A flat panel x-ray tube assembly as in claim 1 further comprising:

a second angled side surface formed in each of said plurality of target wells, each of said second angled side surfaces opposing one of said first angled side surfaces, each of said second angled side surfaces positioned in an acute angle relative to said substrate upper surface; and a plurality of second target elements applied to each said second side surfaces, said plurality of second target elements generating x-rays in a direction perpendicular to said plurality of emitter elements in response to electrons received from one of said plurality of emitter elements.

3. A flat panel x-ray tube assembly as in claim 1 wherein said first target element comprises a thin film.

4. A flat panel x-ray tube assembly as in claim 1 wherein said first target element comprises tungsten.

5. A flat panel x-ray tube assembly as in claim 1 wherein said first angled surface connects a target well base to said substrate upper surface.

6. A flat panel x-ray tube assembly as in claim 1 wherein said first target element is in thermal communication with said first angled surface such that thermal energy accruing during the generation of x-rays is dissipated into said anode substrate.

7. A flat panel x-ray tube assembly as in claim 1 wherein said plurality of target wells comprise a two-dimensional matrix of target wells.

8. A flat panel x-ray tube assembly comprising:

a cathode assembly including a plurality of emitter elements, said plurality of emitter elements generating a plurality of electron beams;

a substrate including a plurality of first angled side surfaces, each of said first angled side surfaces in communication with one of said plurality of electron beams, each of said first angled side surfaces angled relative to said plurality of electron beams such that one of said plurality of electron beams approaches one of said first angled side surfaces at an acute angle; and a plurality of first target elements applied to each of said plurality of first angled side surfaces, wherein said plurality of first target elements comprise at least one line of target each of said plurality of first target elements positioned parallel with one of said plurality of first angled surfaces, each of said plurality of first target elements generating x-rays in a direction parallel to one of said plurality of electron beams.

9. A flat panel x-ray tube assembly as in claim 8 further comprising:

a plurality of second angled side surfaces formed in said substrate, each of said second angled side surfaces facing one of said first angled side surfaces, each of said second angled side surfaces angled relative to said plurality of electron beams such that one of said plurality of electron beams approaches one of said second angled side surfaces at an acute angle; and a plurality of second target elements applied to each of said plurality of second angled side surfaces, each of said plurality of second target elements positioned parallel with one of said plurality of second angled surfaces, each of said plurality of second target elements generating x-rays in a direction parallel to one of said plurality of electron beams.

10. A flat panel x-ray tube assembly as in claim 8 wherein one of said plurality of electron beams approaches one of said first angled side surfaces at an angle less than 45 degrees.

11. A flat panel x-ray tube assembly as in claim 8 wherein said substrate comprises a graphite anode substrate.

12. A flat panel x-ray tube assembly as in claim 8 wherein each of said plurality of first target elements is in thermal communication with said substrate such that thermal energy accruing during the generation of x-rays is dissipated into said substrate.

13. A flat panel x-ray tube assembly as in claim 8 wherein said first target element comprises a thin film.

14. A flat panel x-ray tube assembly as in claim 1 wherein said plurality of first target elements comprise a two-dimensional matrix of target elements.

15. A method of generating a plurality of x-ray beams having a plurality of focal spots comprising:

generating a plurality of electron beams from a plurality of emitter elements;

impacting one of said electron beams into one of a plurality of first target elements, each of said first target elements mounted on a first angled side surface of a substrate; striking said first target element with said electron beam at an acute angle;

releasing x-rays from each of said first target elements in a direction parallel to one of said plurality of electron beams; and dissipating thermal energy from each of said plurality of first target elements into said substrate.

16. A method of generating a plurality of x-ray beams having a plurality of focal spots as described in claim 15, further comprising:

impacting one of said electron beams into one of a plurality of second target elements, each of said second target elements mounted on a second angled side surface of said substrate, said second angled side surfaces facing said first angled side surfaces; and striking said second target element with said electron beam at an acute angle; and releasing x-rays from each of said second target elements in a direction parallel to one of said plurality of electron beams.

17. A method of generating a plurality of x-ray beams having a plurality of focal spots as described in claim 15, further comprising:

generating a plurality of x-ray focal spots along a linear line.

18. A method of generating a plurality of x-ray beams having a plurality of local spots as described in claim 15, further comprising:

generating a plurality of x-ray focal spots along a two dimensional matrix.

* * * * *

UNITED STATES PATENT AND TRADEMARK OFFICE

CERTIFICATE OF CORRECTION

PATENT NO. : 6,975,703 B2
APPLICATION NO. : 10/633251
DATED : December 13, 2005
INVENTOR(S) : Colin Richard Wilson and Mark Ernest Vermilyea It is certified that error appears in the above-identified patent and that said Letters Patent is hereby corrected as shown below:

Claim 8 should read as follows:

A flat panel x-ray tube assembly comprising:

a cathode assembly including a plurality of emitter elements, said plurality of emitter elements generating a plurality of electron beams;

a substrate including a plurality of first angled side surfaces, each of said first angled side surfaces in communication with one of said plurality of electron beams, each of said first angled side surfaces angled relative to said plurality of electron beams such that one of said plurality of electron beams approaches one of said first angled side surfaces at an acute angle; and a plurality of fist target elements applied to each of said plurality of first angled side surfaces, wherein said plurality of first target elements comprise at least one line of target elements, each of said plurality of first target elements positioned parallel with one of said plurality of first angled surfaces, each of said plurality of first target elements generating x-rays in a direction parallel to one of said plurality of electron beams.

Signed and Sealed this

Fifteenth Day of August, 2006

JON W. DUDAS
*Director of the United States Patent and Trademark Office*